United States Patent [19]

Hoffman

[11] 4,437,572

[45] Mar. 20, 1984

[54] SHELF RETAINER

[75] Inventor: Howard O. Hoffman, Elmhurst, Ill.

[73] Assignee: Sears, Roebuck and Co., Chicago, Ill.

[21] Appl. No.: 271,493

[22] Filed: Jun. 8, 1981

[51] Int. Cl.[3] ..... A47F 5/00

[52] U.S. Cl. ..... 211/86; 211/153; 211/184; 108/60; 312/313

[58] Field of Search ..... 211/86, 106, 132, 43, 211/184, 149, 153; 312/313, 291; 108/60

[56] References Cited

U.S. PATENT DOCUMENTS

| | | | |
|---|---|---|---|
| 2,352,345 | 6/1944 | Rundell | 211/153 |
| 2,767,042 | 10/1956 | Kesling | 312/313 |
| 3,145,850 | 8/1964 | Ciborowski | 211/126 |
| 3,388,808 | 6/1968 | Radek | 211/184 X |
| 3,608,741 | 9/1971 | Schray | 211/184 |
| 3,625,371 | 12/1971 | Dill | 312/313 |
| 3,752,324 | 8/1973 | Moser | 211/153 |
| 3,827,574 | 8/1974 | Craig, Sr. | 211/184 |
| 3,851,765 | 12/1974 | Cox | 211/184 |
| 3,893,739 | 7/1975 | Bernard | 211/184 X |
| 3,938,872 | 2/1976 | Hagerman | 312/291 |
| 4,023,682 | 5/1977 | Niece | 211/184 |

*Primary Examiner*—William E. Lyddane
*Assistant Examiner*—Peter A. Aschenbrenner
*Attorney, Agent, or Firm*—Arnstein, Gluck, Lehr, Barron & Milligan

[57] ABSTRACT

A retainer for a shelf including a barrier member. The barrier member is adapted to be supported by the shelf and releasably secured to the shelf in at least two positions of adjustment including an article retaining position and an article access position. With the barrier member secured in the retaining position, articles are prevented from inadvertently falling from the shelf.

8 Claims, 9 Drawing Figures

SHELF RETAINER

FIELD OF THE INVENTION

The present invention relates to a retainer for a shelf and, more particularly, to a retainer for multiple position adjustable installation on a shelf having longitudinally extending openings.

BACKGROUND OF THE INVENTION

In many instances, shelves may be used to support articles of random shape that cannot easily be stacked one upon another. This is particularly true of many of the food packages which can be found in nearly any typical home freezer. It is well known that home freezers are oftentimes used for storage and freezing of food items other than those typically packaged in rectangular shaped cartons or containers, such as the commercially prepared frozen foods bought at supermarkets, and random sized and shaped packages have a propensity for sliding off the packages upon which they are stacked within the freezer and falling to the floor. This can easily result in damage to the plastic breaker strips at the bottom of the freezer compartment. In some instances, a consumer may even be physically injured by reason of the impact of the hard frozen packages.

Because of such hazards, the consumer will commonly stack random shaped packages in an arrangement that slopes upwardly toward the rear of the shelf. The upward and rearward slope succeeds, to a limited degree, in avoiding the tendency for the hard frozen packages to fall from the shelf. Unfortunately, the stacking arrangement needed to accomplish this objective wastes valuable storage space at the front of the shelf.

Among the proposals for overcoming the problems associated with food packages falling from shelves is the device disclosed in U.S. Pat. No. 2,767,042, issued to Keith K. Kesling on Oct. 16, 1956, which proposes a swingable auxiliary food supporting shelf. This shelf, when not utilized as a food support, is adjusted and locked in an upright position in front of packaged frozen foods to form a stop for such foods. With the device disclosed in the Kesling patent, the freezer cabinet must be provided with studs or pins which pass through suitable openings in the sidewalls of an inner liner in the refrigerated chamber. These studs, which serve as hinge pins to permit pivotable movement of the shelf, are threaded into a liner reinforcing member, which increase product cost. Additionally, a swingable auxiliary food supporting shelf of the type disclosed in U.S. Pat. No. 2,767,042 is of no possible benefit to consumers already owning home freezers without this inherent feature.

Another proposed device is disclosed in U.S. Pat. No. 3,752,324, issued to Howard P. Moser on Aug. 14, 1973, which utilizes a shelf guard comprised of upper and lower sections. The upper and lower sections are both provided with hooks whereby the shelf guard is adapted to be suspended from the wire elements of a wire shelf. While this arrangement does not require modifications to, or special provisions within, conventional freezer cabinets, it is unwieldy and must be completely removed to gain access to the contents of any particular shelf. The shelf guard must then be set aside during which time articles could inadvertently fall from any of the shelves. Although the shelf guard disclosed in U.S. Pat. No. 3,752,324 may be useful for its intended purpose, which is retaining food during the limited periods of transport of trailers and mobile homes containing refrigerators, it would have limited utility for day-to-day use in a home freezer.

Still another proposed device is disclosed in U.S. Pat. No. 3,851,765, issued to Don O. Cox on Dec. 3, 1974, which utilizes an elongated generally rectangular sheet-like element as a retainer for refrigerators carried in trailers or other vehicles. The lower edge of the retainer is provided with a plurality of slots arranged to receive the wires or rods of a wire refrigerator shelf. While this arrangement permits access to a particular shelf without unnecessarily removing article restraint from other shelves, the retainer must be completely removed from the shelf and set aside in order to gain access to selected articles. The lower edge of the retainer must also be provided with a plurality of slots arranged in the exact spacing of the particular wires or rods forming a certain wire refrigerator shelf. Since the spacing of the wires or rods can vary significantly from shelf to shelf, the retainer arrangement proposed in U.S. Pat. No. 3,851,765 is not readily adaptable to the wide variety of wire shelving available in home freezers and the like.

Among other shelf retainers, shelf fences, shelf partitions and the like which have been proposed include those disclosed in U.S. Pat. Nos. 3,145,850; 3,608,741; 3,827,574; 3,938,872; and 4,023,682.

In many of the arrangements proposed in the aforementioned patents, one or more of the components, other than the retainer, must be specially manufactured. This renders such retainers unfit for the home freezer after-market. It also unnecessarily adds to the cost of original equipment since modifications to the liners of freezer cabinets, changes in shelving, and other modifications or changes to shelf retainer-shelving combinations require retooling. This results in a retainer which is not readily adapted for use with conventional home freezers. Accordingly, a need has remained for a shelf retainer capable of overcoming the foregoing problems.

Therefore, it is an object of the present invention to provide a shelf retainer which may be secured to a shelf in at least two positions of adjustment including an article retaining position and an article access position.

Another object of the present invention is the provision of a shelf retainer of the type described particularly adapted for multiple position adjustable installation on any of the various types of commonly utilized wire shelving.

A further object of the present invention is the provision of a shelf retainer of the type described including a barrier member permitting random shaped packages to be stacked on a shelf for maximum utilization of storage space.

Still another object of the present invention is the provision of a shelf retainer of the type described which may be easily installed on any of the various types of commonly utilized wire shelving without special fasteners or tools.

Still a further object of the present invention is the provision of a shelf retainer of the type described which is unitary and self-contained for both original equipment and after-market home freezer applications.

These and other objects, features and advantages of the present invention will become more apparent from the following description when the same is considered in conjunction with the accompanyng drawings.

SUMMARY OF THE INVENTION

In general, the objects and advantages of the present invention are met by providing a retainer for a shelf which includes barrier means. The barrier means is adapted to be supported by the shelf and releasably secured to the shelf in at least two positions of adjustment including an article retaining position and an article access position. With the barrier means secured in the retaining position, articles are prevented from inadvertently falling from the shelf.

In a preferred embodiment, the shelf retainer is a unitary, self-contained member for multiple position adjustable installation on a shelf having longitudinally extending openings. The barrier means then includes a base portion supporting it along an edge of the shelf. Also, the barrier means is preferably releasably secured to spaced part logitudinally extending shelf members by means of catch members associated with the base portion at opposite ends thereof. The catch members are disposed on extensions of the base portion projecting downwardly between the longitudinally extending members of the shelf. With the extensions being generally arcuate, the barrier means is pivotable about the edge of the shelf and movable along the edge for selective engagement and disengagement of the catch members with various ones of the longitudinally extending members.

While the shelf retainer is well suited for use with refrig.rated cabinets of a vertical configuration such as upright freezers, it will be appreciated that the invention has much broader applicability. The retainer can advantageously be used with any shelf, particularly any wire shelf, where it is important or desirable to retain articles on the shelf and prevent them from inadvertently shifting and falling.

DETAILED DESCRIPTION OF THE PREFERRED EMBODIMENTS

Figure 1:
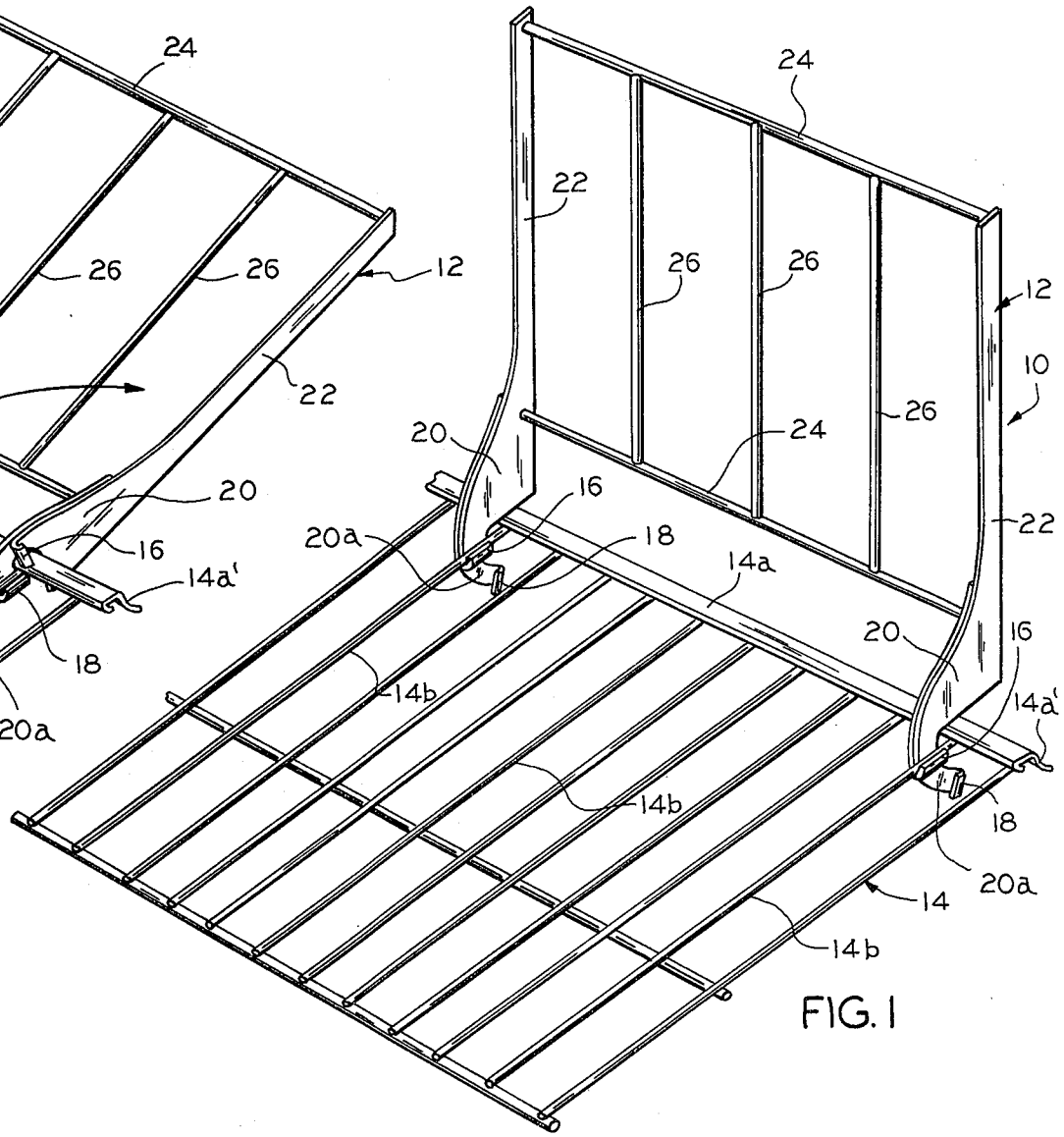
FIG. 1 is a perspective view of a retainer for a shelf in an article retaining position in accordance with the present invention.

Referring first to FIG. 1, the reference numeral 10 designates generally a retainer for a shelf in accordance with the present invention. The retainer 10 includes barrier means, such as fence 12, adapted to be supported by the shelf 14. The fence 12 serves to retain articles on the shelf 14 and is releasably secured to the shelf by suitable means, such as catch members 16 and 18, in at least two positions of adjustment. The retainer 10 also includes a base portion, such as enlargements 20, adapted to support the fence 12 along edge **14*a* of the shelf 14. With this arrangement, the fence 12 can be releasably secured to the shelf 14 in an article retaining position (FIG. 1) and an article access position (FIG. 2**).

In the illustrated embodiments, the shelf retainer 10 is a unitary, self-contained member for multiple position adjustable installation on a wire shelf. Preferably, the two sets of catch members 16 and 18 each include one catch member associated with each of the base portions 20 at opposite ends of the fence 12 for engaging the wires **14*b* of the wire shelf 14. More particularly, the catch members 16 and 18 are disposed on extensions 20*a* of the base portions 20** which project downwardly between the wires of the wire shelf.

Figure 2:
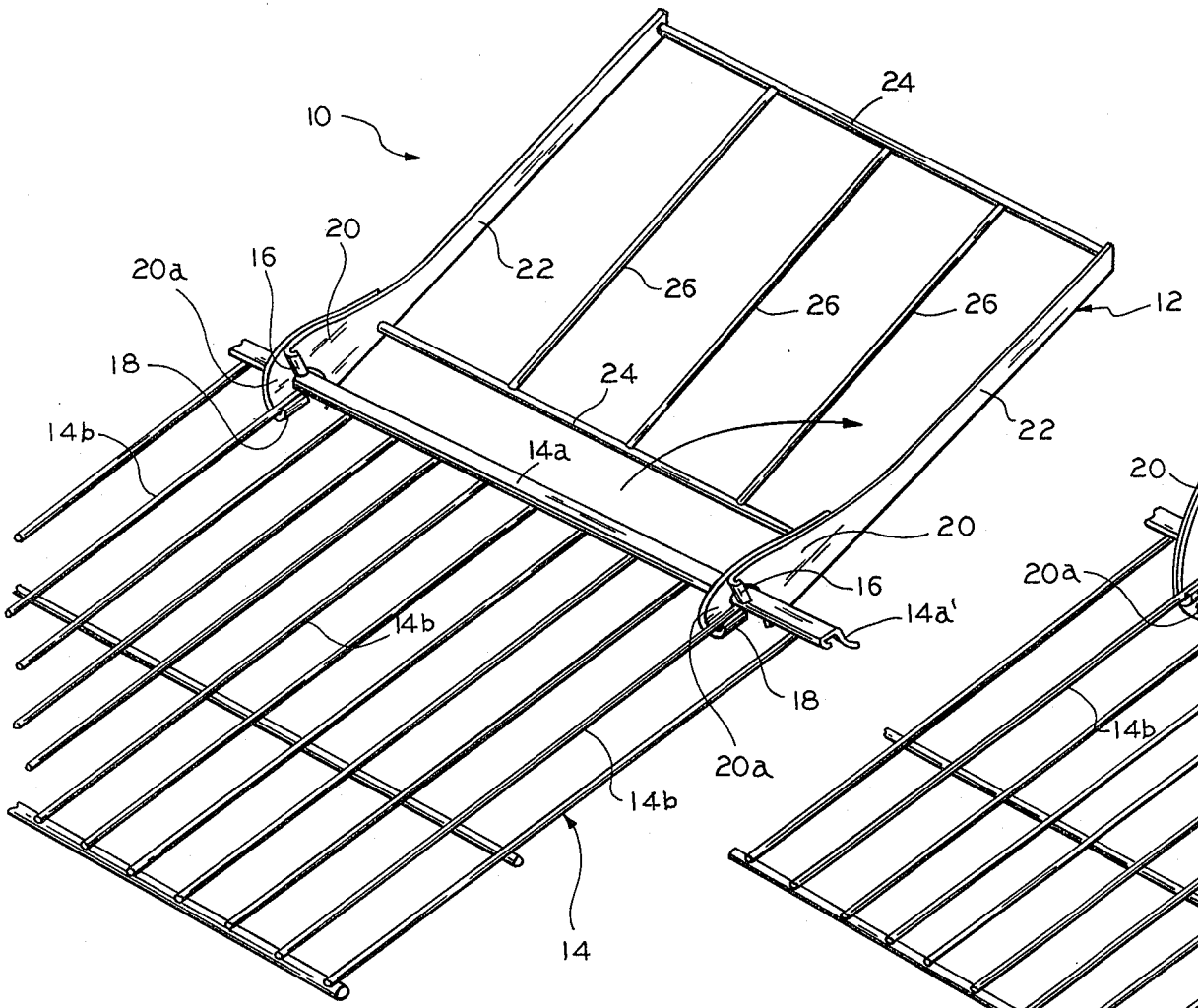
FIG. 2 is a perspective view of the retainer of FIG. 1 on the shelf in an article access position.
Figure 3:
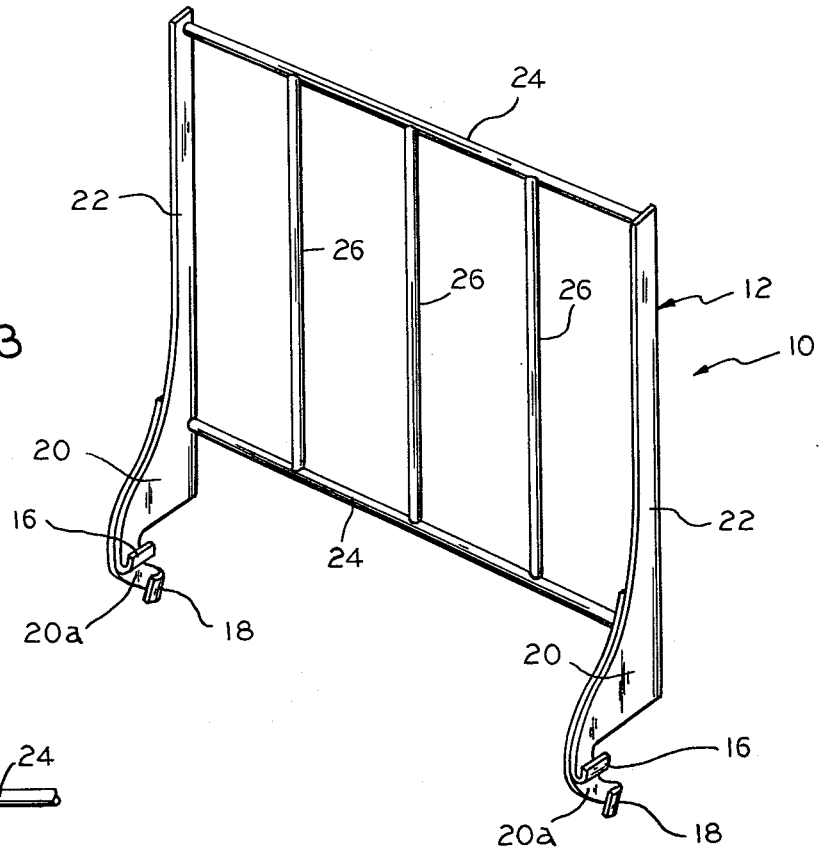
FIG. 3 is a perspective view of the retainer of FIG. 1 removed from the shelf.
Figure 4:
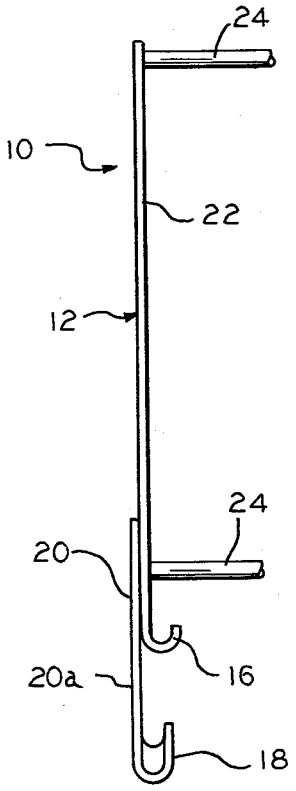
FIG. 4 is a partial rear elevational view of the retainer illustrated in FIG. 3.
Figure 5:
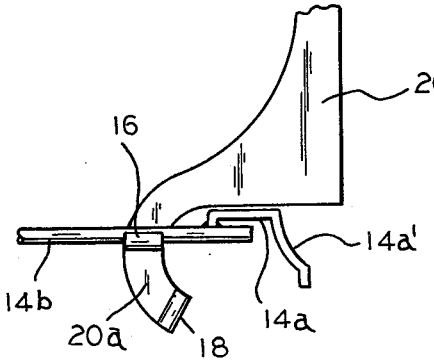
FIG. 5 is a partial end elevational view of the retainer illustrated in FIG. 1 on the shelf in an article retaining position.
Figure 6:
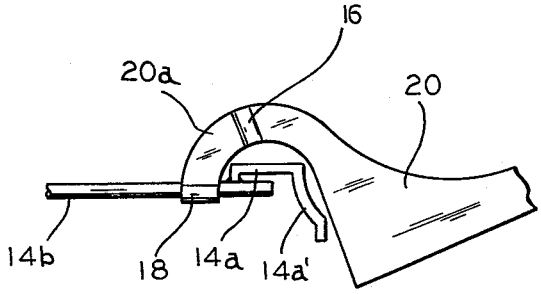
FIG. 6 is a partial end elevational view of the retainer illustrated in FIG. 2 on the shelf in an article access position.

Referring now to FIGS. 1 through 3, the fence 12 includes a pair of end members 22 joined by at least one connecting member 24. It will be seen that, in a preferred embodiment, the fence includes a pair of connecting members 24 extending generally transverse to the end members 22 adjacent the upper and lower ends thereof, and that the base portions 20 comprise the lower ends of the end members 22 immediately below the lower of the connecting members 24. Moreover, the catch members 16 and 18 are arranged on the extensions **20*a* of the base portions 20 such that the catch members 16 secure the fence 12 in the article retaining position (FIG. 5) and the catch members 18 secure the fence 12 in the article access position (FIG. 6**).

Additional details of the embodiment illustrated in FIGS. 1 through 5 include at least one upright member 26 intermediate the end members 22. It will be seen that it is preferred to provide a plurality of upright members 26 with the spacing to be determined by the width of the fence 12 and the nature of the articles to be secured on the shelf 14 and, as shown, the upright members 26 have opposite ends thereof joined to the connecting members 24 so as to extend generally transversely to the connecting members. Also, in this embodiment, at least the base portions 20 and the extensions **20*a* thereof and, preferably, the end members 22 are thin, planar members with the extensions 20*a* projecting downwardly between wires 14*b* of the wire shelf 14, and the catch members 16 and 18 are integrally associated with the thin, planar extensions 20*a* of the base portions 20. It will be seen that the catch members 16 and 18 are generally U-shaped members sized and shaped to receive wires 14*b* of the wire shelf 14 and, additionally, the catch members 16 are disposed generally above the catch members 18 and at an angle to the catch members 18 to accomplish the objective of securing the fence 12 in the article retaining position and the article access position. More particularly, the catch members 16 preferably extend transversely of the fence 12 to secure the fence transversely of the wire shelf 14 (FIG. 1) and the catch members 18 extend generally parallel to the fence 12 to secure the fence generally parallel to the wire shelf 14 (FIG. 2**).

Still referring to FIGS. 1 through 5, the extensions **20*a* of the base portions 20 are generally arcuate portions thereof. The fence 12 is pivotable about the edge 14*a* of the wire shelf 14 on the arcuate portions of the base portions 20 and are movable along the edge 14***a* of the wire shelf 14 on the base portions 20 of the fence 12. It will be appreciated that the pivotable and movable fence 12 permits selective engagement and disengagement of the catch members 16 and 18 with the wire shelf 14. The catch members 16 and 18 are preferably disposed on corresponding surfaces of the base portions 20 to face in the same direction. With this arrangement, the fence 12 is easily movable along the edge 14*a* of the wire shelf 14 until the corresponding surfaces engage wires 14*b* of the wire shelf 14 after which the fence 12 is pivotable about the edge 14*a* of the wire shelf 14 for selective engagement and disengagement of the catch members 16 and 18 with wires 14*b* of the wire shelf 14.

More particularly, in operation, the shelf retainer 10 is easily moved from an article retaining position to an article access position. If the shelf retainer 10 is in an article retaining position, as shown in FIG. 1, the fence 12 may be pivoted about the edge 14*a* of the wire shelf 14 in a counterclockwise direction to disengage the catch member 16 from the wires 14*b*. The fence 12 may then be moved along the edge 14*a* of the wire shelf 14 in a direction opposite to the direction the catch members 16 and 18 face until there is sufficient clearance for the catch member 16 to pass upwardly through the space between adjacent wires 14*b* on opposite sides of the extensions 20*a* of the base portions 20. The fence 12 may then be pivoted about the edge 14*a* of the wire shelf 14 in a clockwise direction until the catch members 16 are disposed above the shelf and the catch members 18 are still disposed below the shelf. The fence 12 may then be moved along the edge 14*a* of the wire shelf 14 in the direction which the catch members 16 and 18 face until the corresponding surfaces of the base portions 20 contact wire 14*b*. The fence 12 may then be pivoted further in a clockwise direction to engage the catch members 18 with the wires 14*b* of the wire shelf 14. With the shelf retainer 10 then being in an article access position, as shown in FIG. 2, the fence 12 can later be moved to an article access position by merely reversing the above procedure. Accordingly, the shelf retainer 10 is easily installed, simple to use, economically manufactured and effective for its intended purpose.

Figure 7:
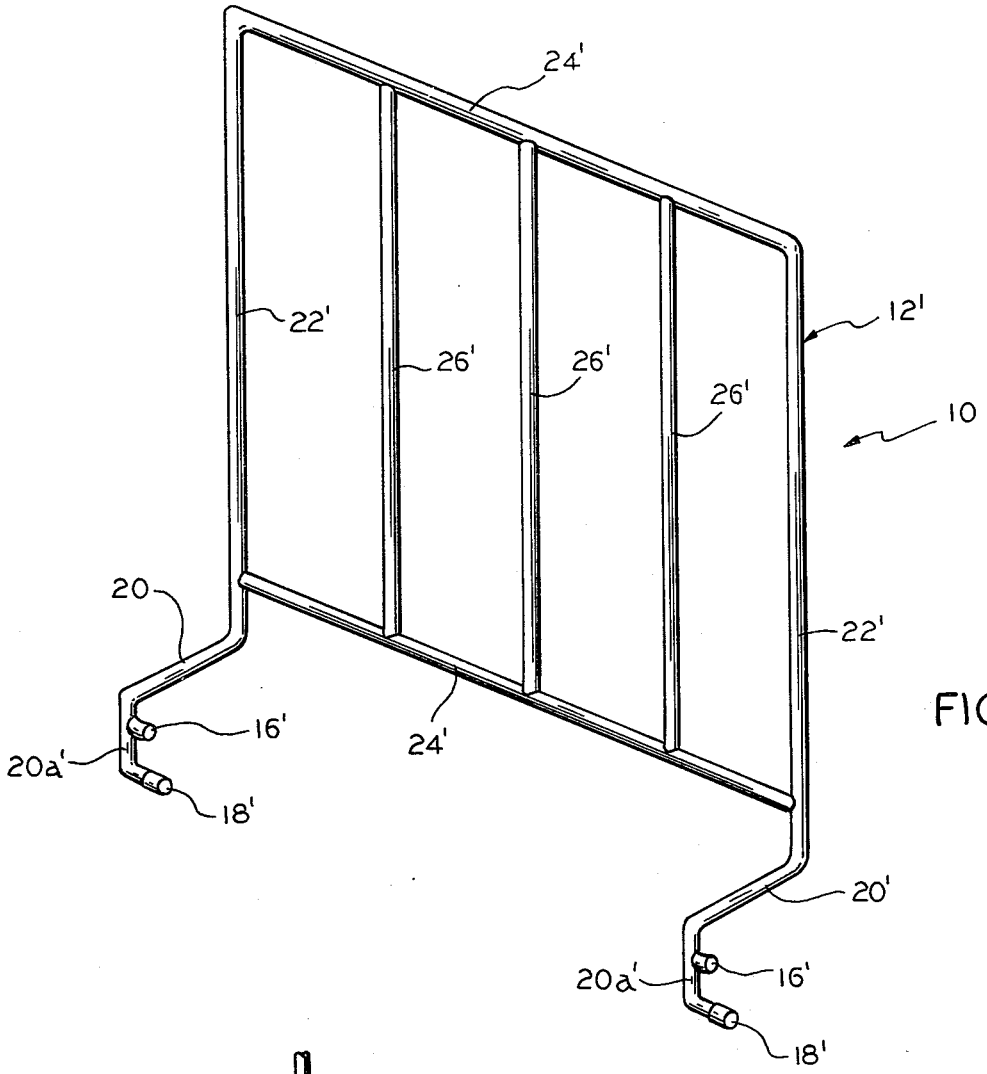
FIG. 7 is a perspective view of another embodiment of a retainer for a shelf in accordance with the present invention.
Figure 8:
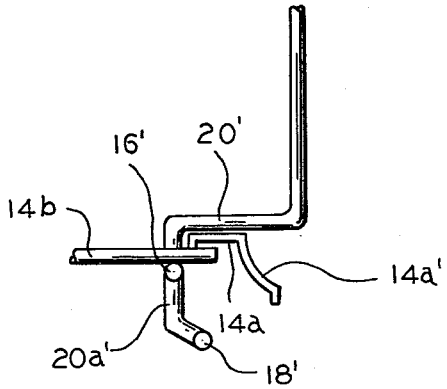
FIG. 8 is a partial end elevational view of the retainer illustrated in FIG. 7 on a shelf in an article retaining position.
Figure 9:
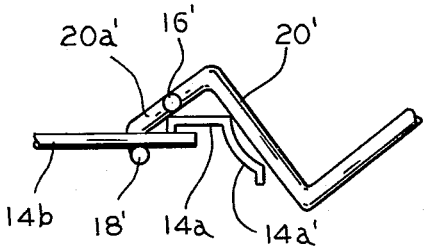
FIG. 9 is a partial end elevational view of the retainer illustrated in FIG. 7 on a shelf in an article access position.

Referring now to the alternative embodiment illustrated in FIGS. 7 through 9, it will be appreciated that the shelf retainer 10' is very similar to the shelf retainer 10. It includes a fence 12' formed of end members 22', connecting members 24', and upright members 26'. The fence 12' also includes base portions 20' for supporting it on a shelf, particularly a wire shelf. It further includes extensions 20*a'* extending downwardly from the base portions 20' (which are generally L-shaped instead of arcuate) upon which are formed catch members 16' and 18'. While the components of the shelf retainer 10' are very similar to the components of the shelf retainer 10, it will be appreciated that the principal difference is in the construction of the two devices.

More particularly, while shelf retainer 10 includes end members 22 formed of thin, planar material, shelf retainer 10' is entirely formed of stiff wire. The latter arrangement may provide some economies in construction and, in any event, both retainers are well suited for the intended purpose. As will be appreciated by comparing FIGS. 5 and 6 with FIGS. 8 and 9, the shelf retainers 10 and 10' are used in identical fashion.

As will be appreciated from FIGS. 7 through 9, the catch members 16' and 18' include laterally projecting wire members in contrast to the generally U-shaped catch member 16 and 18 of the embodiment illustrated in FIGS. 1 through 6. Still referring to FIGS. 7 through 9, the catch members 16' and 18' may be provided with plastic end caps to assure that the consumer is safe from any possible rough edges or burrs and to also provide a certain frictional gripping force in cooperation with the wires of a wire shelf.

As shown in the drawings, the edge 14*a* of the wire shelf 14 includes a lip 14*a'*. This lip 14*a'* is conventional, particularly in refrigerated cabinets of a vertical configuration such as upright freezers. The lip is not, however, required and, it will be appreciated by those skilled in the art that it is only necessary that the wire shelf 14 be provided with an edge capable of supporting the fence 12. This edge will then dicate the exact dimension, shape and location of the base portions, extensions, and catch members.

When the shelf retainer is to be used with refrigerated cabinets, the wire shelf usually is provided with conventional spacing. This makes it possible to provide retainers having extensions which are adapted to project between wires thereof and also makes it possible to have one or more retainers capable of traversing the entire width of the shelf. Moreover, the extensions, whether arcuate or substantially L-shaped, can be sized and shaped to work in the intended fashion.

With regard to refrigerated cabinets of the vertical configuration such as upright freezers, the shelves conventionally have longitudinally extending openings or gaps with a spacing between the longitudinally extending members or wires of $\frac{3}{8}''$, $\frac{1}{2}''$, $\frac{3}{4}''$, or $1''$. The $\frac{3}{8}''$ spacing dictates that the base portions and extensions be quite thin and that the catch members similarly be sufficiently small for insertion between wires of the shelves in the intended fashion. It is also generally recognized that each of the shelves can advantageously be provided with multiple retainers, each of a length to accommodate all wire spacings, or a fixed portion of the shelf width for a specific wire spacing and of a height sufficient to retain articles on the shelves taking into account the usual range of spacing between shelves. The utilization of multiple retainers for each shelf permits access to a portion of the shelf for removing an article while safely and effectively retaining articles on the other portion of the shelf. When the article has been removed from the shelf, the retainer, which was lowered to the article access position for removal of this article, can be moved back to the article retaining position in the intended fashion.

Various changes coming within the spirit of the present invention may suggest themselves to those skilled in the art. Hence, it will be understood that the invention is not to be limited to the specific embodiments shown and described or the uses mentioned. On the contrary, the specific embodiments and uses are intended to be merely exemplary with the present invention being limited only by the true spirit and scope of the appended claims.

I claim:

1. A unitary retainer for linear and angular adjustable installation on a shelf having longitudinally extending openings defined by spaced apart longitudinally extending shelf members, comprising:

barrier means adapted to be positioned along an edge of said shelf, said barrier means including a pair of base portions supporting said barrier means on said edge of said shelf, said barrier means serving to retain articles on said shelf; and means for releasably securing said barrier means to said shelf, said releasable securing means being associated with said base portions of said barrier means and including means for engaging said longitudinally extending shelf members in at least two positions, said positions including an article retaining position and an article access position;

said barrier means also including a pair of end members joined by a planar barrier, one of said base portions being integral with each of said end members such that at least a part of said base portions is adapted to extend downwardly between longitudinally extending shelf members, said engaging means being integrally associated with said downwardly extending part of said base portions.

2. The retainer as defined by claim 1 wherein said planar barrier includes a pair of connecting members joined to said pair of end members, and wherein said downwardly extending part of said base portions are planar.

3. The retainer as defined by claim 2 wherein said engaging means includes a pair of generally U-shaped catch members integrally associated with each of said extensions of said base portions, said catch members being sized and shaped to receive said longitudinally extending shelf members therein.

4. The retainer as defined in claim 3 wherein one set of said catch members secure said barrier means in said article retaining position and a second set of said catch members secure said barrier means in said article access position.

5. The retainer as defined by claim 4 wherein said first set of said catch members are disposed generally above said second set of said catch members, said first set of said catch members being disposed at an angle to said second set of said catch members.

6. The retainer as defined by claim 5 wherein said first set of said catch members extend transversely to the plane of said barrier means to secure said barrier means transversely to the plane of said shelf, said second set of said catch members extending generally parallel to the plane of said barrier means to secure said barrier means generally parallel to the plane of said shelf.

7. The retainer as defined by claim 5 wherein said extensions of said end members are generally arcuate portions thereof, said barrier means being pivotable about said edge of said shelf on said arcuate portions of said members and moveable along said edge of said shelf on said base portions of said barrier means, said pivotable and moveable barrier means permitting selective engagement and disengagement of said catch members with said longitudinally extending shelf members.

8. The retainer as defined by claim 2 wherein said engaging means includes a pair of catch members integrally associated with each of said extensions of said base portions, said catch members being disposed on surfaces of said base portions facing in the same direction, said barrier means being movable along said edge of said shelf until said surfaces of said base portions facing in the same direction engage said longitudinally extending shelf members, said barrier means being pivotalable about said edge of said shelf for selective engagement and disengagement of said catch members with said longitudinally extending shelf members.

* * * * *